US005899780A

United States Patent [19]

Robbins

[11] Patent Number: 5,899,780

[45] Date of Patent: May 4, 1999

[54] ROWING APPARATUS

[76] Inventor: Gerald Mark Robbins, 1885 N. Snelling Ave., Falcon Heights, Minn. 55113

[21] Appl. No.: 08/632,571

[22] Filed: Apr. 12, 1996

[51] Int. Cl.[6] ..... B63H 16/067

[52] U.S. Cl. ..... 440/105; 114/363; 248/430; 297/311; 440/106

[58] Field of Search ..... 114/363; 440/104, 440/105, 106, 108, 109; 297/311, 344.11; 248/424, 429, 430; 267/131, 133

[56] References Cited

U.S. PATENT DOCUMENTS

| | | | |
|---|---|---|---|
| 655,410 | 1/1900 | Davis | 440/105 |
| 2,033,637 | 3/1936 | Kaiser | 114/363 |
| 2,557,972 | 6/1951 | Jewett | 9/7 |
| 3,881,713 | 5/1975 | Joyce | 267/131 |
| 3,898,950 | 8/1975 | Martin | 115/24.1 |
| 4,068,611 | 1/1978 | Leather | 115/24.1 |
| 4,290,156 | 9/1981 | Rawson | 9/1.1 |
| 4,352,218 | 10/1982 | Lundberg | 114/363 |
| 4,411,214 | 10/1983 | Horiuchi | 114/347 |
| 4,432,525 | 2/1984 | Duvall | 248/430 |
| 4,649,852 | 3/1987 | Piantedosi | 114/363 |
| 4,768,459 | 9/1988 | Cerkvenik et al. | 114/363 |
| 4,943,051 | 7/1990 | Haskins et al. | 272/72 |
| 4,943,250 | 7/1990 | DuPont | 440/101 |
| 5,016,557 | 5/1991 | Miller | 114/347 |

FOREIGN PATENT DOCUMENTS

| | | | |
|---|---|---|---|
| 758146 | 1/1934 | France | 440/106 |
| 3019514 | 11/1981 | Germany | 440/105 |

*Primary Examiner*—Sherman Basinger
*Attorney, Agent, or Firm*—Chad A. Klingbeil; Moore & Hansen

[57] ABSTRACT

A rowing apparatus having support tubing that extends over the gunnels of the canoe, and to which the oars are mounted, is angled upwardly to provide added clearance in choppy waters. The elongated track support to which the seat and the support tubing are mounted is provided with repositionable mounting brackets that enable the height from the floor of the elongated support member to be adjusted within a range of several inches to maintain a suitable center of gravity for a wide range of weather conditions. In this manner the rower is capable of maximizing the transfer of power through the rowing apparatus, and still maintain the stability of the canoe. Since wilderness rowing is a physically demanding activity, the rowing apparatus is easily adaptable for use as a training device, permitting the user of the apparatus to use the same device in their home for exercise and training purposes that they can also use in their canoe on an actual wilderness rowing expedition.

39 Claims, 3 Drawing Sheets

ROWING APPARATUS

BACKGROUND OF THE INVENTION

1. Technical Field

The present invention relates generally to rowing mechanisms used in small watercraft. In particular, the invention relates to rowing machines using human power that may be mounted within canoes or rowing sculls, and which also may be used separately for physical conditioning.

2. Background Information

Rowing machines for exercise in the home and gym have been known for a long time. Similarly, albeit more recently, rowing mechanisms for use in canoes or other small watercraft have also been commercialized. One of the central advantages of these mechanisms in small watercraft is that, by using the strength of the legs and both arms, combined with the leverage provided by an oar pivoting at an oar lock extended outwardly from the side of the canoe, they more efficiently convert the energy generated by the human body for propelling the boat over the water.

Initial iterations of this type of mechanism have proven effective, although not particularly sturdy. When used in actual rowing conditions, especially over extended periods of time and over great distances, the construction of these machines has proven to be unreliable and not sturdy enough to handle the rigors of demanding use.

It has also been learned that certain adjustments made to the configuration of components of the apparatus result in significant improvements in performance. For example, in waters with large waves, the outriggers to which the oars are mounted on prior art devices have proven to be too low for practical use. Furthermore, the rolling mechanism of the seat has not been very durable, resulting in breakdowns, which can be a significant problem if the rower is in the wilderness and unable to summon assistance. It is also helpful to permit the position of the foot rests to be adjustable relative to the outriggers to which the oars are mounted for rowers of different sizes.

Prior rowing mechanisms have also added greatly to the weight of the canoe or other small watercraft. When portages of great distances are contemplated for the canoe, the added weight can be a significant difficulty for the person carrying the load.

The rowing apparatus of the present invention overcomes difficulties described above and affords other features and advantages heretofore not available.

SUMMARY OF THE INVENTION

Wilderness rowing, involving extended canoe expeditions in isolated regions, is becoming increasingly popular among outdoor enthusiasts. Among the most important features needed by a canoe under these circumstances are durability and light weight. The canoes must be durable to handle extended periods of heavy use, and they must be light weight to make long portages safe and easy.

For a solo transcontinental expedition, the inventor required a rowing apparatus that would provide the ultimate in reliability and light weight. At the same time, it was also necessary to ensure that the rowing apparatus would be stable and provide maximum performance characteristics in a wide variety of weather and rowing conditions. Thus, the support tubing which extends over the gunnels of the canoe and to which the cars are mounted were angled upwardly to provide added clearance in choppy waters. The elongated support member to which the seat and the support tubing are slidably mounted was provided with repositionable mounting brackets that enable the height of the elongated support member from the floor to be adjusted within a range of several inches to maintain a suitable center of gravity for a wide range of weather conditions. In this manner the rower is capable of maximizing the transfer of power through the rowing apparatus, and still maintain the stability of the canoe. Furthermore, the seat is angled upward slightly at the rear to provide added support to the spine during rowing expeditions that last for weeks or months. Adjustable, pivoting foot supports are provided to further maximize comfort and ease of use. Since wilderness rowing is a physically demanding activity, the rowing apparatus is easily adaptable for use as a training device, permitting the user of the apparatus to use the same device in their home for exercise and training purposes that they can also use in their canoe on an actual wilderness rowing expedition.

It is thus an object of the present invention to provide a rowing apparatus that maximizes the transfer of the pulling power of the rower to forward motion of the watercraft. It is a further object of this invention to provide a rowing apparatus that is useful in a wide variety of weather and water conditions, including on waters with very high waves, by elevating the position of the oar locks over the height of a conventional rowing apparatus. It is a further object of this invention to provide a rowing apparatus that is easily convertible into a conditioning apparatus for training in preparation for a wilderness rowing expedition. It is a further object of this invention to provide a rowing apparatus that may be easily disassembled and reassembled for simple repairs and maintenance using small, commonly available tools. It is a primary object of this invention to provide a rowing apparatus that is sturdy and durable, light in weight and comfortable, so that it may be reliably used for extended periods. It is a further object of this invention to provide such a rowing apparatus that may be used with a wide variety of small watercraft hull configurations.

Other objects and advantages of the invention will become apparent from the following detailed description and from the appended drawings in which like numbers have been used to describe like parts throughout the several views.

DESCRIPTION OF THE PREFERRED EMBODIMENT

Figure 1:
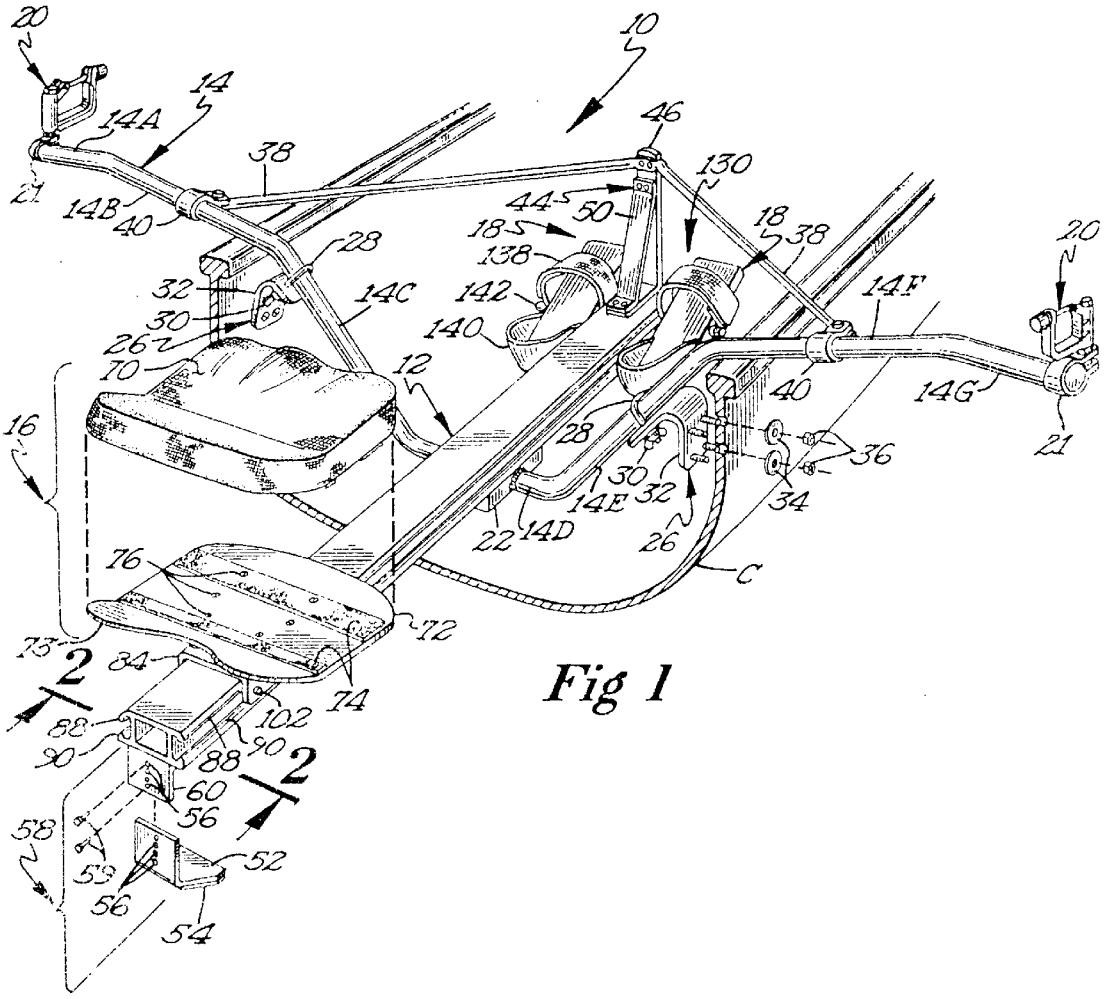
FIG. 1 shows a partially exploded perspective view of the rowing apparatus of the present invention.

With reference to the drawings, and in particular to FIG. 1, the rowing apparatus is generally indicated by reference numeral 10. Rowing apparatus 10 includes an elongated track support 12 to which is mounted outrigger support 14, seat assembly 16 and stirrup assembly 18. Outrigger support 14 is preferably configured of aluminum tubing for light weight and strength. On the ends of outrigger support 14 are oar lock assemblies 20, to which are releasably attached oars O, preferably using tubing clamps 21. Rowing apparatus 10 is shown positioned within the hull of a canoe C.

Figure 2:
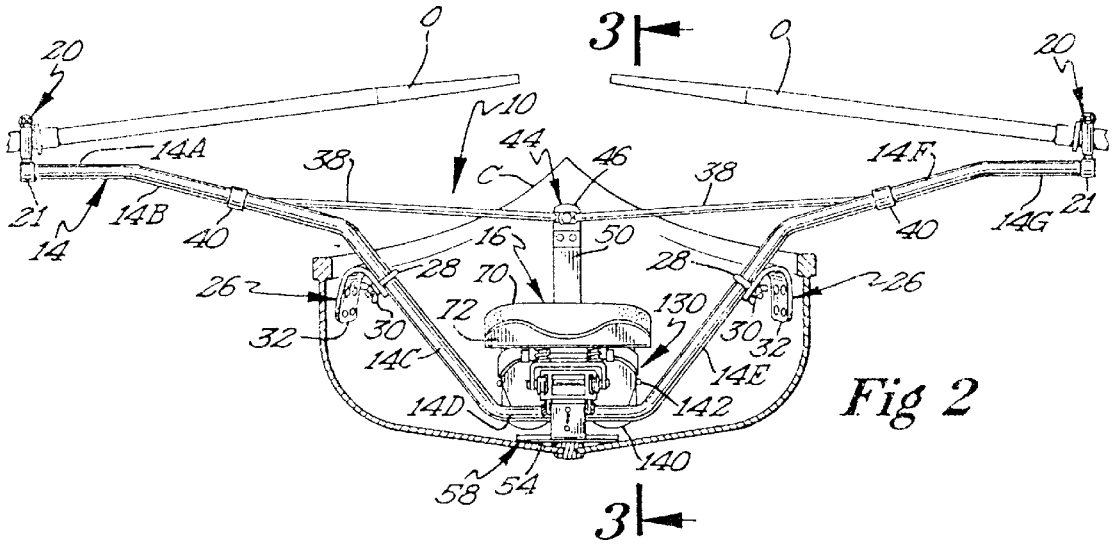
FIG. 2 shows a rear view of the rowing apparatus installed in a canoe taken along line 2—2 of FIG. 1.

The configuration of outrigger support tubing 14 includes six bends, dividing outrigger support 14 into seven portions, 14A–14G, as best illustrated in FIG. 2. The bends in outrigger support 14 are symmetrical, with segments 14A and 14G extending outwardly generally horizontally. It is important for the proper operation of rowing apparatus 10 that segments 14A and 14G be generally horizontal since they have oar lock assemblies 20 attached thereto. Segment 14D of outrigger support 14 is fixedly attached as by welding to a mounting block 22, which in turn is releasably attached as by bolts 24 to track support 12. The use of bolts 24 or some other easily detachable means of fastening mounting block 22 to track support 12 assures easy detachment of outrigger support 14 from rowing apparatus 10 in unexpected circumstances in the wilderness, such as when portaging through confined locations.

Attached to segments 14C and 14E of outrigger support 14 are bracket assemblies 26 for attachment of outrigger support 14 to the hull of canoe C. Bracket assemblies 26 preferably include releasable threaded clamps 28 attached as by wing nuts 30 to mounting plates 32. Mounting plates 32 are preferably attached to the hull of canoe C as by stainless steel fender washers 34 and nuts 36. Wing nuts 30 are used to enable the easy removal of rowing apparatus 10 from canoe C.

Figures 3, 4:
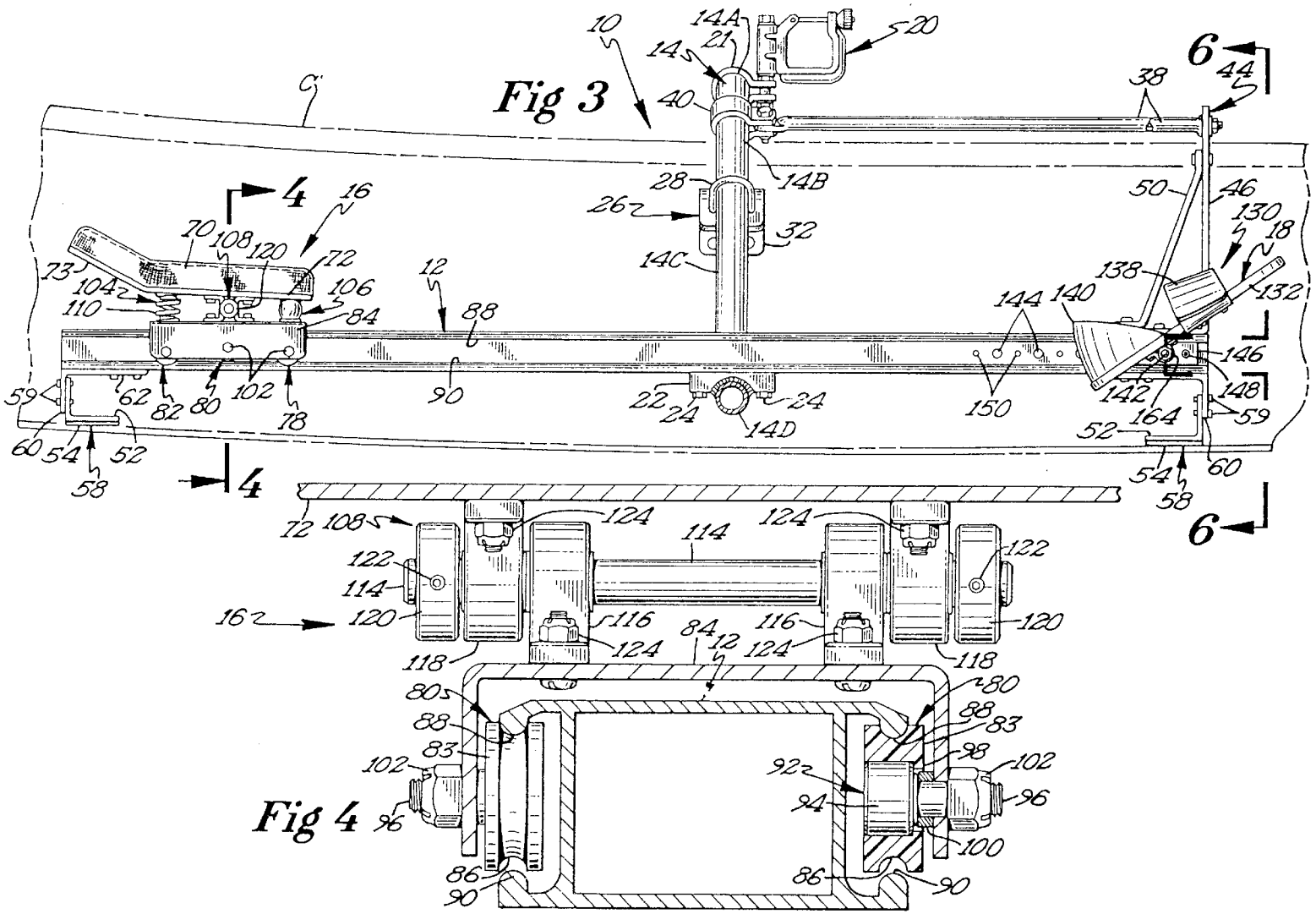
FIG. 3 shows a right side view of the rowing apparatus taken along line 3—3 of FIG. 2.
FIG. 4 shows a rear sectional view of the seat support assembly of the rowing apparatus taken along line 4—4 of FIG. 3.

As best shown in FIGS. 1 and 3, attached to segments 14B and 14F of outrigger support 14, which extend outwardly over the gunnels of canoe C, are angled braces 38. Braces 38 preferably are attached to outrigger support 14 using tubing clamps 40, which preferably releasably engage braces 38 with Allen bolts 42. The opposite ends of braces 38 are attached to a brace support tower 44, which is securely attached to elongated track support 12. Brace support tower 44 preferably includes a vertical member 46 having a horizontal portion 48 attached to track support 12, and an angled strength member 50 extending from the end of horizontal portion 48 to the top of the vertical member 46.

For stability, track support 12, also preferably made of aluminum, as are nearly all of the metal components of rowing apparatus 10, rests on support members 52, which in turn are positioned on the floor of canoe C. Support members 52 include a thin foot pad 54, preferably made of rubber, to minimize the effects of rubbing against the floor of canoe C. Such rubbing could be especially problematic with lighter weight canoes, for which rowing apparatus 10 is especially well suited, which are commonly made of fiberglass. As illustrated in FIG. 1, support members 52 include a row of holes 56, permitting adjustable engagement with mounting bracket 58 using bolts 59. As may be seen in FIG. 3, mounting bracket 58, which includes a corresponding row of holes 56, includes a shorter side 60 and a longer side 62. Both sides 60, 62 include a row of holes 56 for engaging support member 52, and also for attachment to the bottom of track support 12. The two sides 60, 62 are thus interchangeable, affording the person using rowing apparatus 10 the opportunity to adjust the height of the apparatus in the canoe for maximum stability and generation of power while rowing, depending on the condition of the weather and the water in which the canoe is located.

Figure 5:
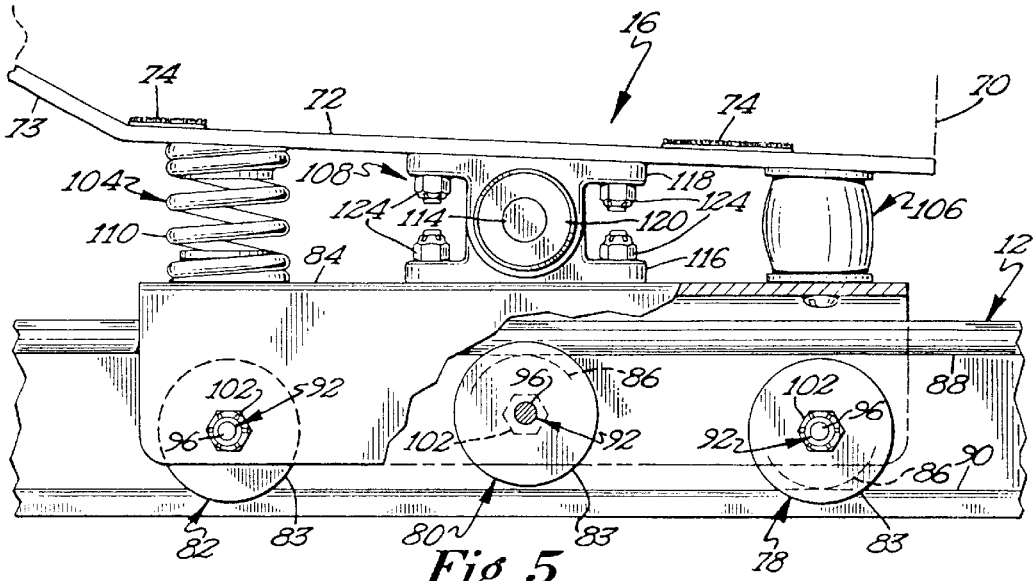
FIG. 5 shows a right side, partially cut away view of the seat support assembly shown in FIG. 4.

Seat assembly 16, as illustrated in FIGS. 4 and 5, is also specially adapted for the particular needs of wilderness rowing. Seat assembly 16 includes a padded portion 70, which may include an outer lining with a releasable enclosure means, such as a zipper (not shown), for replacing the actual padding contained therein. The padding contained within padded portion 70 may come in a variety of materials and thicknesses, and is preferably interchangeable so that the person using rowing apparatus 10 may change the padding depending on their changing needs during the course of a rowing expedition. Padded portion 70 is releasably attachable to seat plate 72, using a releasable attachment means such as VELCRO strips 74, to permit easy access to the screws 76 attaching seat plate 72 to seat assembly 16. Seat plate 72 preferably includes an upwardly angled portion 73 to provide added support for the person sitting on seat assembly 16. Seat plate 72 may be made of aluminum, although fabrication from graphite reduces weight while maintaining strength and durability.

Referring to FIG. 5, it may be seen that seat assembly 16 includes a carriage portion having one pair of front wheel assemblies 78, middle wheel assemblies 80 and rear wheel assemblies 82, respectively, rotatably mounted to a carriage plate 84. Wheel assemblies 78, 80 and 82 each include a rolling member 83 having a circumferential groove 86 along the periphery thereof, as shown in FIG. 4, that engages at least one of the downwardly extending rails 88 or upwardly extending rails 90 on the left and right sides of track support 12. Rolling members 83 are preferably made of a plastic having a very low coefficient of friction, such as DELRIN AF. As shown in FIG. 5, front and rear wheel assemblies 78, 82 are generally coplanar, while middle wheel assembly 80 is positioned slightly higher. Thus, under normal operating conditions, the circumferential grooves 86 of front and rear wheel assemblies 78, 82 engage upwardly extending rail 90, while the circumferential 86 of middle wheel assembly 80 engages downwardly extending rail 88.

Rolling members 83 of front, middle and rear wheel assemblies 78, 80 and 82, respectively, are mounted to an axle assembly 92. Axle assembly 92 preferably includes a bushing assembly 94 such as made by Accurate Bushing Co. of Garwood, N.J. and sold under model no. HR-5/8X, having a threaded member 96 protecting therefrom. It is preferable that the bushing assembly 94 include needle bearings rather than ball bearings for added strength and durability. Referring to FIG. 4, rolling members 83 include a reduced diameter lip 98 extending around the periphery of the outer opening thereof. The bushing assembly 94 of axle assembly 92 is pressed into rolling member 83, with threaded member 96 protecting from the opening of rolling member 83 that includes lip 98. When attaching wheel assemblies 78, 80, 82 to carriage plate 84, threaded member 96 of axle assembly 92 is positioned in the appropriate opening, after positioning at least two washers 100 over threaded member 96. Washers 100, preferably made of stainless steel for durability, although acceptably fabricated of fiberglass, are smaller than the inside diameter of lip 98, and bear against the outer surface of bushing assembly 94 to provide spacing between rolling member 83 and carriage plate 84. Wheel assemblies 78, 80, 82 are maintained in position after installation by a locknut 102.

Referring to FIG. 5, seat plate 72 rests on a spring assembly 104, a bumper assembly 106 and a pivot assembly 108. Spring assembly 104 is of the type commonly found on bicycle seats, including first and second springs 110 fastened on one end to seat plate 72 and on the other end to the horizontal surface of carriage plate 84. Bumper assembly 106 includes two rubber bump stops 112 also fastened on one end to seat plate 72 and on the other end to the horizontal surface of carriage plate 84.

Referring to FIG. 4, pivot assembly 108 includes a stainless steel rod 114 extending through and between carriage plate straps 116, as well as seat plate straps 118. Retained within carriage plate straps 116 and seat plate straps 118 are bearings, not shown, having rod 114 passing therethrough. These bearings are preferably made of wood impregnated with oil at high pressure. Identical retaining collars 120, fastened to rod 114 using set screws 122, maintain rod 114 in proper position in pivot assembly 108. Straps 116, 118 are preferably retained in position with locknuts 124.

Figure 6:
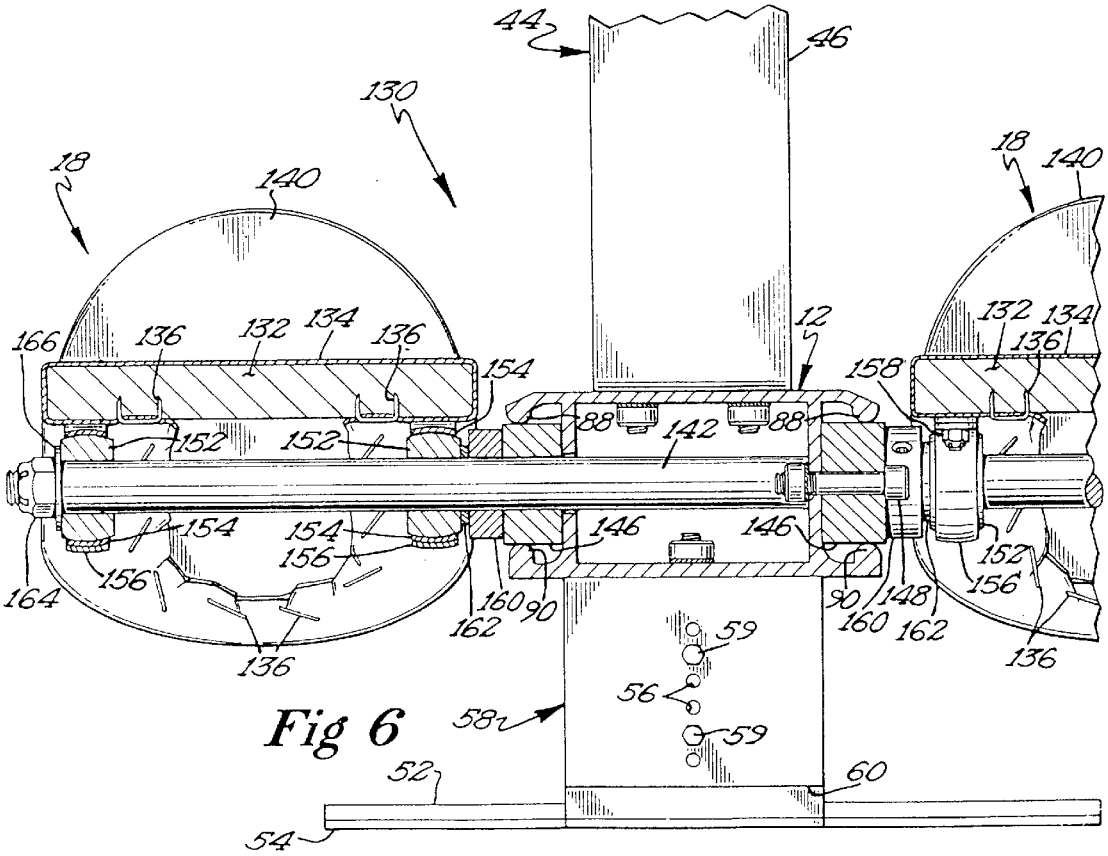
FIG. 6 shows a front, sectional view of the elongated support member taken along line 6—6 of FIG. 3, illustrating the pivoting foot support.

Referring to FIG. 6, pivoting foot support assembly 130 is illustrated, showing wooden foot rests 132 having a plastic or vinyl covering 134 attached thereto as by staples 136. Toe straps 138, shown in FIG. 3, attach to the sides of foot rests 132 to assist in holding the foot in position, as do heel restraints 140. Toe straps 138 are preferably adjustable to accommodate a variety of different foot sizes. Foot rests 132 are rotatably attached to stainless steel rod 142, which extends through a large diameter hole 144 in track support 12. Rod 142 is held in position by two aluminum blocks 146, which are releasably attached to track support 12 as by bolts 148, which engage small diameter holes 150 therein. Foot rests 132 are connected to rod 142 with bearings 152, which are retained within foot rest hold downs 154 and retaining straps 156, which in turn are attached to foot rests 132 with nut and bolt assemblies 158. Bearings 152 are preferably the same as those used with pivot assembly 108 of seat assembly 16. Foot rests 132 are maintained in position by spacers 160, which are preferably the same as retaining collars 120 of pivot assembly 108 of seat assembly 16. Spacers 160 bear against aluminum blocks 146, and are separated from bearings 152 by washers 162. Finally, foot rests 132 are held on to rod 142, which includes a threaded portion on each end, by nuts 164, bearing against washers 166. The position of foot support assembly 130 along track support 12 may easily be adjusted by releasing one of the end nuts 164, removing the rod 142 from the large diameter hole 144 in which it is positioned, relocating it to another large diameter hole 144 and repositioning the other elements of the assembly along rod 142. The alternating arrangement of large diameter holes 144 and small diameter holes 150, as shown in FIG. 3, permits the easy repositioning of aluminum blocks 146 in any corresponding position with newly relocated rod 142.

While the preferred embodiments of the invention have been described, it should be understood that various changes, adaptations and modifications may be made therein without departing from the spirit of the invention and the scope of the appended claims.

What is claimed is:

1. A rowing apparatus for use with a canoe or other small watercraft, the apparatus comprising:

a rigid longitudinal support member having a first end, a second end, a top side, a bottom side, a left side, a right side and an intermediate portion;

a multi-segmented outrigger member attached to said longitudinal support member, said outrigger member having a central portion and first and second wing portions projecting from said central portion, said central portion being attached to said intermediate portion of said longitudinal support member, each said wing portion having a first angled segment extending from said central portion, a second angled segment extending from said first angled segment, and an end segment, said end segments extending generally parallel to said central portion, whereby oarlocks may be attached to said end segments of said first and second wing portions;

a seat assembly, said seat assembly slidably attached to said longitudinal support member;

a foot support assembly, said foot support assembly including first and second foot supports; and a strut assembly including a support tower, said strut assembly supporting said outrigger member, said support tower of said strut assembly being attached to said longitudinal support member.

2. The rowing apparatus described in claim 1, wherein said strut assembly further comprises:

first and second rigid braces, each said brace having a first end and a second end, said first end of each said brace being attached to said support tower, said second end of said first brace being attached to said first wing portion of said outrigger member and said second end of said second brace being attached to said second wing portion of said outrigger member.

3. The rowing apparatus described in claim 2, wherein:

said second end of said first brace is attached to said second angled segment of said first wing portion of said outrigger member and said second end of said second brace is attached to said second angled segment of said second wing portion of said outrigger member.

4. The rowing apparatus described in claim 2, further comprising:

first and second support assemblies releasably attached to and downwardly depending from said longitudinal support member and resting on the floor of the watercraft, said first support assembly attached to said first end of said longitudinal support member and said second support assembly attached to said second end of said longitudinal support member.

5. The rowing apparatus described in claim 4, wherein said first and second support assemblies further comprise:

a mounting bracket having a short side and a long side, said short side and said long side of said mounting bracket being releasably engageable with said bottom side of said longitudinal support member; and a support member releasably engageable with said short side and said long side of said mounting bracket, said support member having a foot portion for positioning the rowing apparatus on the floor of the watercraft.

6. The rowing apparatus described in claimed, wherein said support members further comprise:

a foot pad fixedly attachable to said foot portion, whereby said foot pad protects the floor of the watercraft from damage from said support member.

7. The rowing apparatus described in claim 5, further comprising:

attachment means releasably engageable with said outrigger member for releasably attaching the rowing apparatus to the watercraft.

8. The rowing apparatus described in claim 7, wherein said attachment means comprises:

first and second brackets fixedly attachable to the sides of the watercraft, said first bracket being releasably engageable with said first angled segment of said first wing portion of said outrigger member, and said second bracket being releasably engageable with said first angled segment of said second wing portion of said outrigger member.

9. The rowing apparatus described in claim 1, wherein said longitudinal support member further comprises:

seat assembly engaging means extending along said right side and said left side thereof.

10. The rowing apparatus described in claim 9, wherein seat assembly comprises:

a carriage plate having a front portion, an intermediate portion and a rear portion;

rolling means rotatably attached to said carriage plate and engageable with said seat assembly engaging means of said longitudinal support member;

a suspension assembly attached to said carriage plate;

a seat plate attached to said suspension assembly, said seat plate having a front portion, an intermediate portion and a rear portion; and a cushioned seat assembly releasably attachable to said seat plate.

11. The rowing apparatus described in claim 10, wherein said suspension assembly comprises:

a bumper assembly attached to said front portion of said carriage plate and said front portion of said seat plate;

a pivot assembly attached to said intermediate portion of said carriage plate and said intermediate portion of said seat plate; and a spring assembly attached to said rear portion of said carriage plate and said rear portion of said seat plate.

12. The rowing apparatus described in claim 11, wherein said pivot assembly comprises:

a pivot rod having a first end and a second end;

at least one first bearing assembly attached to said seat plate, said pivot rod passing through said at least one first bearing assembly; and at least one second bearing assembly attached to said carriage plate, said pivot rod passing through said at least one second bearing assembly.

13. The rowing apparatus described in claim 12, wherein said pivot assembly further comprises:

first and second retaining collars attached to said first end and said second end, respectively, of said pivot rod for maintaining the proper position of said pivot rod within said at least one first bearing assembly and said at least one second bearing assembly.

14. The rowing apparatus described in claim 10, wherein said rolling means comprises:

a plurality of rolling members engageable with said seat assembly engaging means of said longitudinal support member.

15. The rowing apparatus described in claim 14, wherein said seat assembly engaging means comprises:

a first downwardly extending rail projecting from said right side of said longitudinal support member;

a first upwardly extending rail projecting from said right side of said longitudinal support member, said first upwardly extending rail positioned opposably from said first downwardly extending rail;

a second downwardly extending rail projecting from said left side of said longitudinal support member; and a second upwardly extending rail projecting from said left side of said longitudinal support member, said second upwardly extending rail positioned opposably from said second downwardly extending rail.

16. The rowing apparatus described in claim 15, wherein said rolling members of said rolling means comprise:

a wheel having a first side and a second side, said wheel having circumferential groove about the periphery thereof for engaging at least one of said downwardly and upwardly extending rails;

a bearing assembly to which said wheel is mounted;

an aperture along the axis of said wheel for receiving said bearing assembly; and an axle member projecting from said first side of said wheel, said axle member extending along the axis of said bearing assembly.

17. The rowing apparatus described in claim 16, wherein said wheel further comprises:

an inwardly projecting lip on said first side of said wheel about the periphery of said aperture, said bearing assembly bearing against said lip.

18. The rowing apparatus described in claim 16, wherein said carriage plate further comprises:

a central generally horizontal section including said front portion, said intermediate portion and said rear portion;

a first side and a second side, said central section extending between said first and second sides; and first and second downwardly depending support sections, said first and second support sections connected to said first and second sides, respectively, of said carriage plate, said first and second support sections having a plurality of apertures for receiving said rolling members, said rolling members projecting inwardly from said first and second support sections for rolling engagement with said seat assembly engaging means of said longitudinal support member.

19. The rowing apparatus described in claim 18, wherein:

said first and second support sections of said carriage plate each have three apertures for receiving said rolling members, said first and third apertures being generally coplanar, and said second aperture being positioned somewhat above the plane defined by said first and third apertures, whereby said circumferential grooves of said rolling members of said first and third apertures of said first support section engage said first upwardly extending rail of said longitudinal support member, said circumferential groove of said rolling member of said second aperture of said first support section engages said first downwardly extending rail of said longitudinal support member, said circumferential grooves of said rolling members of said first and third apertures of said second support section engage said second upwardly extending rail of said longitudinal support member, and said circumferential groove of said rolling member of said second aperture of said second support section engages said second downwardly extending rail of said longitudinal support member.

20. The rowing apparatus described in claim 10, wherein said seat plate further comprises:

an upwardly angled support portion projecting from said rear portion of said seat plate, said support portion providing support to the spine of the person resting on said seat assembly.

21. The rowing apparatus described in claim 1, wherein:

said first and second foot supports of said foot support assembly are pivotally and releasably attached to said longitudinal support member.

22. The rowing apparatus described in claim 1, further comprising: attachment means engageable with said outrigger member for fastening the rowing apparatus to the watercraft.

23. The rowing apparatus described in claim 22, wherein said attachment means comprises:

first and second bracket assemblies fastened to the sides of the watercraft, said bracket assemblies releasably engageable with said first angled segment of said first and second wing portions, respectively, of said outrigger member.

24. The rowing apparatus described in claim 1, wherein said longitudinal support member comprises:

a single beam member having a top side, a bottom side, a left side and a right side.

25. The rowing apparatus described in claim 24, wherein said beam member further comprises:

first and second generally downwardly extending rail portions projecting from said top of said right and left sides, respectfully, of said beam member;

and first and second generally upwardly extending rail portions projecting from said bottom of said right and left sides, respectfully, of said beam member, said first generally downwardly extending rail portion and said first generally upwardly extending rail portion forming a first seat assembly engagement portion for cooperation with said seat assembly, and said second generally downwardly extending rail portion and said second generally upwardly extending rail portion forming a second seat assembly engagement portion for cooperation with said seat assembly, whereby said first and second seat engagement portions facilitate said slidable relationship between said seat assembly and said longitudinal support member.

26. A rowing apparatus for use with a canoe or other small watercraft, the apparatus comprising:

a rigid longitudinal support member comprising a single beam member having a first end, a second end, a top side, a bottom side, a left side, a right side and an intermediate portion, said rigid longitudinal support member having a seat assembly slidably attached thereto, said rigid longitudinal support member further including first and second generally downwardly extending rail portions projecting from said top of said right and left sides, respectfully, of said beam member, and first and second generally upwardly extending rail portions projecting from said bottom of said right and left sides, respectfully, of said beam member, said first generally downwardly extending rail portion and said first generally upwardly extending rail portion forming a first seat assembly engagement portion for cooperation with said seat assembly, and said second generally downwardly extending rail portion and said second generally upwardly extending rail portion forming a second seat assembly engagement portion for cooperation with said seat assembly, whereby said first and second seat engagement portions facilitate said slidable relationship between said seat assembly and said longitudinal support member;

a multi-segmented outrigger member attached to said longitudinal support member, said outrigger member having a central portion and first and second wing portions projecting from said central portion, said central portion being attached to said intermediate portion of said longitudinal support member, each said wing portion having a first angled segment extending from said central portion, a second angled segment extending from said first angled segment, and an end segment, said end segments extending generally parallel to said central portion, whereby oarlocks may be attached to said end segments of said first and second wing portions; and a foot support assembly attached to said rigid longitudinal support member, said foot support assembly including first and second foot supports.

27. A rowing apparatus for use with a canoe or other small watercraft, the apparatus comprising:

a rigid longitudinal support member having a first end, a second end, a top side, a bottom side, a left side, a right side and an intermediate portion;

a multi-segmented outrigger member attached to said longitudinal support member, said outrigger member having a central portion and first and second symmetrical wing portions projecting from opposite ends of said central portion, said central portion being attached to said intermediate portion of said longitudinal support member;

a strut assembly including a support tower, said strut assembly supporting said outrigger member, said support tower of said strut assembly being attached to said longitudinal support member;

a seat assembly, said seat assembly slidably attached to said longitudinal support member; and a foot support assembly, said foot support assembly including first and second foot supports.

28. The rowing apparatus described in claim 27, wherein said wing portions of said outrigger member further comprise:

a first angled segment extending from said central portion, a second angled segment extending from said first angled segment, and an end segment, said end segments extending generally parallel to said central portion, whereby oarlocks may be attached to said end segments of said first and second wing portions.

29. The rowing apparatus described in claim 28, wherein said strut assembly further comprises:

first and second rigid braces, each said brace having a first end and a second end, said first end of each said brace being attached to said support tower, said second end of said first brace being attached to said first wing portion of said outrigger member and said second end of said second brace being attached to said second wing portion of said outrigger member.

30. The rowing apparatus described in claim 29, wherein:

said second end of said first brace is attached to said second angled segment of said first wing portion of said outrigger member and said second end of said second brace is attached to said second angled segment of said second wing portion of said outrigger member; and first and second bracket assemblies fastened to the sides of the watercraft for fastening the rowing apparatus to the watercraft, said bracket assemblies releasably engageable with said first angled segment of said first and second wing portions, respectively, of said outrigger member.

31. A seat assembly and longitudinal seat support for rolling engagement of the seat assembly with the longitudinal seat support, comprising:

rigid longitudinal seat support member having a left side and a right side;

seat assembly engaging means extending along said right side and said left side of said longitudinal seat support for engaging the seat assembly;

a carriage plate on the seat assembly, said carriage plate having a front portion, an intermediate portion and a rear portion;

rolling means rotatably attached to said carriage plate and engageable with said seat assembly engaging means of said longitudinal support member;

a seat plate attached to first and second spring means and at least one first bearing assembly and at least one second bearing assembly, said seat plate having a front portion, an intermediate portion and a rear portion, whereby said first spring means is attached to said front portion of said carriage plate and said front portion of said seat plate, and said second spring means is attached to said rear portion of said carriage plate and said rear portion of said seat plate;

a pivot rod attached to said intermediate portion of said carriage plate and said intermediate portion of said seat plate, said pivot rod having a first end and a second end, said pivot rod passing through said at least one first bearing assembly and said at least one second bearing assembly;

an upwardly angled support portion projecting from said rear portion of said seat plate, said support portion providing support to the spine of the person resting on the seat assembly; and a cushioned seat assembly releasably attachable to said seat plate.

32. The seat assembly and longitudinal seat support described in claim 31, wherein:

said first spring means comprises a bumper assembly; and said second spring means comprises a spring assembly.

33. The seat assembly and longitudinal seat support described in claim 32, wherein:

first and second retaining collars are attached to said first end and said second end, respectively, of said pivot rod for maintaining the proper position of said pivot rod within said at least one first bearing assembly and said at least one second bearing assembly.

34. The seat assembly and longitudinal seat support described in claim 33, wherein said rolling means comprises:

a plurality of rolling members engageable with said seat assembly engaging means of said longitudinal seat support member.

35. The seat assembly and longitudinal seat support described in claim 34, wherein said seat assembly engaging means comprises:

a first downwardly extending rail projecting from said right side of said longitudinal support member;

a first upwardly extending rail projecting from said right side of said longitudinal support member, said first upwardly extending rail positioned opposably from said first downwardly extending rail;

a second downwardly extending rail projecting from said left side of said longitudinal support member; and a second upwardly extending rail protecting from said left side of said longitudinal support member, said second upwardly extending rail positioned opposably from said second downwardly extending rail.

36. The seat assembly and longitudinal seat support described in claim 35, wherein said rolling members of said rolling means comprise:

a wheel having a first side and a second side, said wheel having circumferential groove about the periphery thereof for engaging at least one of said downwardly and upwardly extending rails;

a bearing assembly to which said wheel is mounted;

an aperture along the axis of said wheel for receiving said bearing assembly; and an axle member projecting from said first side of said wheel, said axle member extending along the axis of said bearing assembly.

37. The seat assembly and longitudinal seat support described in claim 36, wherein said wheel further comprises:

an inwardly projecting lip on said first side of said wheel about the periphery of said aperture, said bearing assembly bearing against said lip.

38. The seat assembly and longitudinal seat support described in claim 36, wherein said carriage plate further comprises:

a central generally horizontal section including said front portion, said intermediate portion and said rear portion;

a first side and a second side, said central section extending between said first and second sides; and first and second downwardly depending support sections, said first and second support sections connected to said first and second sides, respectively, of said carriage plate, said first and second support sections having a plurality of apertures for receiving said rolling members, said rolling members projecting inwardly from said first and second support sections for rolling engagement with said seat assembly engaging means of said longitudinal support member.

39. The seat assembly and longitudinal seat support described in claim 38, wherein:

said first and second support sections of said carriage plate each have three apertures for receiving said rolling members, said first and third apertures being generally coplanar, and said second aperture being positioned somewhat above the plane defined by said first and third apertures, whereby said circumferential grooves of said rolling members of said first and third apertures of said first support section engage said first upwardly extending rail of said longitudinal support member, said circumferential groove of said rolling member of said second aperture of said first support section engages said first downwardly extending rail of said longitudinal support member, said circumferential grooves of said rolling members of said first and third apertures of said second support section engage said second upwardly extending rail of said longitudinal support member, and said circumferential groove of said rolling member of said second aperture of said second support section engages said second downwardly extending rail of said longitudinal support member.

* * * * *